US012687016B2

(12) United States Patent
Van Sloun et al.

(10) Patent No.: US 12,687,016 B2
(45) Date of Patent: Jul. 21, 2026

(54) NON-COMBUSTIBLE EDGE FOR INSULATED CONCRETE SANDWICH WALL PANELS

(71) Applicant: Owens Corning Intellectual Capital, LLC, Toledo, OH (US)

(72) Inventors: Jeffrey Van Sloun, Perrysburg, OH (US); Tiffany Coppock, Kerens, TX (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 18/633,714

(22) Filed: Apr. 12, 2024

(65) Prior Publication Data

US 2024/0254765 A1 Aug. 1, 2024

Related U.S. Application Data

(63) Continuation of application No. 17/226,186, filed on Apr. 9, 2021, now Pat. No. 11,982,084.

(60) Provisional application No. 63/008,493, filed on Apr. 10, 2020.

(51) Int. Cl.
*E04B 2/92* (2006.01)
*E04B 2/84* (2006.01)

(52) U.S. Cl.
CPC ..... *E04B 2/92* (2013.01); *E04B 2/847* (2013.01)

(58) Field of Classification Search
CPC ... E04B 1/14; E04B 1/942; E04B 2/92; E04B 2/847; E04C 2/284; E04C 2/388; E04C 2/46
See application file for complete search history.

(56) References Cited

U.S. PATENT DOCUMENTS

| | | | | |
|---|---|---|---|---|
| 2,999,043 | A | 9/1961 | Glynn | |
| 7,832,166 | B2 * | 11/2010 | Daniels | E06B 5/161 52/784.11 |
| 8,636,941 | B1 | 1/2014 | Ciuperca | |
| 8,844,223 | B2 | 9/2014 | Zhong | |
| 10,744,674 | B2 | 8/2020 | Ciuperca | |
| 2004/0050100 | A1 | 3/2004 | Ungerleider et al. | |
| 2004/0067352 | A1 | 4/2004 | Hagerman et al. | |
| 2006/0263575 | A1 | 11/2006 | Ritchie | |
| 2010/0325989 | A1 | 12/2010 | Leahy | |
| 2011/0061329 | A1 | 3/2011 | Tadros et al. | |

(Continued)

FOREIGN PATENT DOCUMENTS

| | | | |
|---|---|---|---|
| CN | 102758497 | A | 10/2012 |
| EP | 2224071 | A2 | 9/2010 |

(Continued)

OTHER PUBLICATIONS

Office Action from U.S. Appl. No. 17/226,186 dated Mar. 2, 2023.

(Continued)

*Primary Examiner* — Jessica L Laux
(74) *Attorney, Agent, or Firm* — Calfee, Halter & Griswold LLP

(57) ABSTRACT

An insulation system for use with a sandwich wall panel is disclosed. The insulation system reduces the risk of flame spread through the sandwich wall panels. The insulation (Continued)

system provides a balance between good insulating properties and reduced flammability, without detrimentally increasing the cost of the sandwich wall panel.

17 Claims, 2 Drawing Sheets

(56) References Cited

U.S. PATENT DOCUMENTS

| | | | | |
|---|---|---|---|---|
| 2011/0305868 | A1* | 12/2011 | Heytens | E04B 1/803 428/116 |
| 2013/0071604 | A1 | 3/2013 | Lemieux et al. | |
| 2013/0227902 | A1* | 9/2013 | Van Sloun | B32B 5/18 264/261 |
| 2016/0130812 | A1 | 5/2016 | Karle et al. | |

FOREIGN PATENT DOCUMENTS

| | | | |
|---|---|---|---|
| EP | 2907933 | A1 | 8/2015 |
| JP | 2004162471 | A | 6/2004 |
| JP | 2010229664 | A | 10/2010 |
| JP | 2017227121 | A | 12/2017 |
| WO | 03062548 | A1 | 7/2003 |
| WO | 2004024645 | A2 | 3/2004 |
| WO | 2011110172 | A1 | 9/2011 |
| WO | 2017135917 | A1 | 8/2017 |
| WO | 2017171558 | A1 | 10/2017 |
| WO | 2019027348 | A1 | 2/2019 |

OTHER PUBLICATIONS

Office Action from U.S. Appl. No. 17/226,186 dated Jul. 19, 2023.
Notice of Allowance from U.S. Appl. No. 17/226,186 dated Jan. 12, 2024.
International Search Report and Written Opinion from PCT/US2021/026518 dated Jul. 7, 2021.
Office Action from JP Application No. 2022-561450 dated Nov. 25, 2024.
Office Action from AU Application No. 2021253598 dated Feb. 21, 2025.
Book 3, "Design of Assembled Concrete Structures," Zhang Haidong et al., p. 119, Yellow River Water Conservancy Press, Feb. 2018 (Translation of Relevant Portion Provided).
Office Action from KR Application No. 10-2022-7038507 dated May 13, 2025.
Office Action from JP Application No. 2022-561450 dated Jun. 2, 2025.
Office Action from CN Application No. 202180034033.6 dated Jun. 11, 2025.
Office Action from CN Application No. 202180034033.6 dated Sep. 6, 2024.
"Designers' Material List Interior", Liu Huajiang et al., p. 160, Tongji University Press, Oct., 2017 (Translation of Relevant Portion Provided).
"Pictorial Book for Building Decoration Materials", Kang Haifei et al., p. 531, Shanghai Science and Technology Press, Feb., 2012 (Translation of Relevant Portion Provided).

* cited by examiner

NON-COMBUSTIBLE EDGE FOR INSULATED CONCRETE SANDWICH WALL PANELS

CROSS-REFERENCE TO RELATED APPLICATIONS

This application is a continuation of U.S. application Ser. No. 17/226,186, filed Apr. 9, 2021, which claims priority to and any benefit of U.S. Provisional Application No. 63/008,493, filed Apr. 10, 2020, the contents of which are incorporated herein by reference in its entirety.

FIELD

The present invention relates to insulation systems for buildings and occupied structures, and more particularly, to systems that avoid various problems associated with conventional concrete sandwich wall panels.

BACKGROUND

Conventional exterior building cladding (facing) is often made using preformed concrete wall panels. In many climates, the concrete panels will need additional insulation. One arrangement for such an exterior cladding is to "sandwich" a panel or board of insulation (e.g., foam) between two segments of concrete wall paneling. To maximize the insulative effect, it is desirable to have the insulation reach to the edges of the concrete wall panels. However, this arrangement often leaves the potentially combustible foam insulation exposed, which can pose a risk for fire in certain instances.

Therefore, a need exists for an insulation system that can provide adequate insulation to concrete sandwich wall panels while avoiding the potential for combustion of the insulation.

SUMMARY

The general inventive concepts are based, in part, on the discovery that conventional, concrete sandwich wall panels suffer from a risk of combustion of the inner insulative material. One means of dealing with this issue is to replace the entire inner insulator with an insulator that is non-combustible. However, such a change is often cost-prohibitive and could add significant weight, such as in the case of cellular glass. Therefore, the general inventive concepts seek to balance the insulative capacity and low cost of foam insulation with the non-combustibility of cellular glass insulation. This is achieved by positioning non-combustible cellular glass insulation as an edge around the otherwise combustible foam insulator panel.

In certain exemplary embodiments, the general inventive concepts contemplate a sandwich wall panel assembly. The sandwich wall panel assembly comprises a first wall panel and a second wall panel positioned opposite one another. Positioned between the first and second wall panels is a first insulator and a second insulator. The first insulator is sized to take up the majority of the area between the first and second wall panels and the second insulator is a ribbon of material positioned on at least one edge of the perimeter of the first insulator.

In certain exemplary embodiments, the general inventive concepts contemplate a sandwich wall panel assembly. The sandwich wall panel assembly comprises a first building wall panel having a first major surface facing a first exterior of the sandwich wall panel assembly and a second major surface facing a first interior of the sandwich wall panel assembly; a second building wall panel having a first major surface facing a second exterior of the sandwich wall panel assembly and a second major surface facing a second interior of the sandwich wall panel assembly; a first insulating member having a first major surface and a second major surface and a plurality of edges defining a perimeter of the first insulating member, the first insulating member positioned between the first building wall panel and the second building wall panel; and a second insulator in the form of at least one segment positioned about at least one of the edges.

In certain exemplary embodiments, the general inventive concepts contemplate a method of manufacturing a sandwich wall panel assembly. The method comprises providing a first building wall panel having a first major surface facing a first exterior of the sandwich wall panel assembly and a second major surface facing a first interior of the sandwich wall panel assembly; providing a second building wall panel having a first major surface facing a second exterior of the sandwich wall panel assembly and a second major surface facing a second interior of the sandwich wall panel assembly; positioning a first insulator between the first building wall panel and the second building wall panel, the first insulator having a first major surface and a second major surface and a plurality of edges defining a perimeter; and positioning a second insulator in the form of at least one segment about at least one of the edges.

Other aspects and features of the general inventive concepts will become more readily apparent to those of ordinary skill in the art upon review of the following description of various exemplary embodiments in conjunction with the accompanying figures.

BRIEF DESCRIPTION OF THE DRAWINGS

The general inventive concepts, as well as embodiments and advantages thereof, are described below in greater detail, by way of example, with reference to the drawings in which.

DETAILED DESCRIPTION

Several illustrative embodiments will be described in detail with the understanding that the present disclosure merely exemplifies the general inventive concepts. Embodiments encompassing the general inventive concepts may take various forms and the general inventive concepts are not intended to be limited to the specific embodiments described herein.

While various exemplary embodiments are described or suggested herein, other exemplary embodiments utilizing a variety of methods and materials similar or equivalent to those described or suggested herein are encompassed by the general inventive concepts.

Unless defined otherwise, all technical and scientific terms used herein have the same meaning as commonly understood by one of ordinary skill in the art to which the invention belongs. In this connection, unless otherwise indicated, concentrations of ingredients given in this document refer to the concentrations of these ingredients in the master batch or concentrate, in keeping with customary practice.

The general inventive concepts relate to systems for and methods of insulating a sandwich wall panel. In particular, the general inventive concepts contemplate a system for insulating a sandwich wall panel that reduces or avoids the risk of flammability associated with common insulator materials (i.e., polymer foams).

In the case of sandwich wall panel assemblies, the exterior of the wall panel assembly is often made of concrete or other inflammable or fire resistant material. These are insufficient insulators for many climates. Thus, an additional insulator is often "sandwiched" between the wall panel assemblies of the exterior material. However, conventional insulators such as polymer foams, while having the benefits of being both inexpensive and efficient insulators, also carry with them the risk of flammability. The general inventive concepts seek to overcome this flammability, while retaining the good insulation and low cost of conventional insulators.

Cellular glass is a non-porous, closed-cell foam material that is rigid in structure, has a vapor permeability of zero, and is inflammable. Cellular glass has a relatively high insulative capacity, making it a preferred insulating material for certain applications, especially those that can take advantage of the other unique properties of cellular glass, e.g., high mechanical strength, rigidity, dimensional stability, chemical inertness, water and/or water vapor proofing, water/steam resistance, insect/rodent resistance, and/or other barrier properties or resistances.

While the general inventive concepts are applicable to a variety of insulation materials, the cellular glass for use according to the general inventive concepts is characterized by a high degree of dimensional stability and inflammability, making it an excellent choice for protecting the inner/first insulation material.

Figure 1:
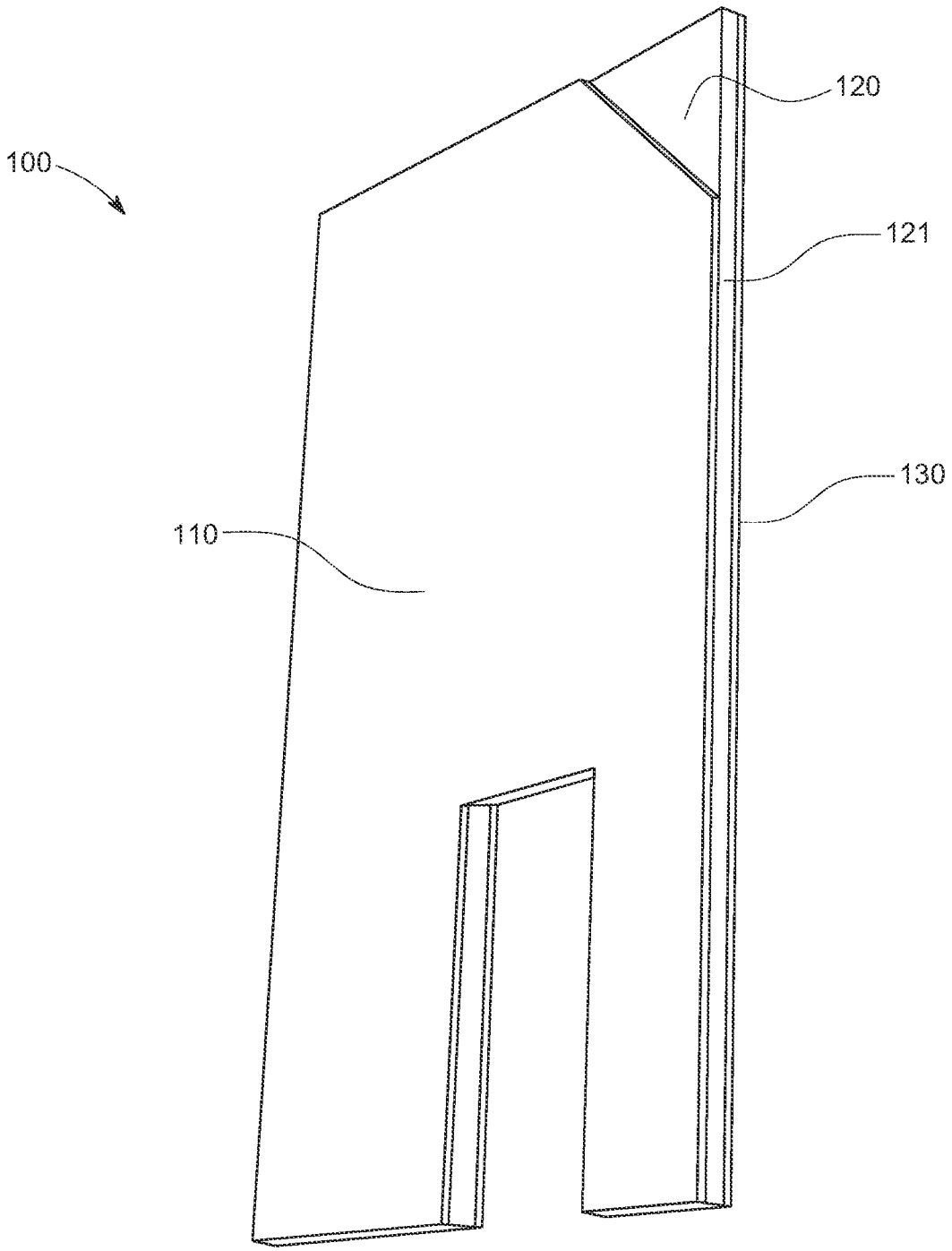
FIG. 1 PRIOR ART
FIG. 1 shows an illustration of a conventional concrete sandwich wall panel.

FIG. 1 shows an exemplary sandwich wall panel assembly, 100. The panel is formed with opposing building wall panels of construction material, 110, 130 (e.g., concrete). Positioned between the opposing concrete panels (110, 130) is a layer or board of insulation 120 (e.g., polymer foam). As can be seen from the figure, the perimeter edges of the insulation 120 is sized to reach substantially to the perimeter edges of the exterior wall panels 110, 130. In other words, the insulation material has substantially the same shape as that of the wall panels. Such an arrangement avoids transmission of heat/energy via gaps between the insulation material.

Figure 2:
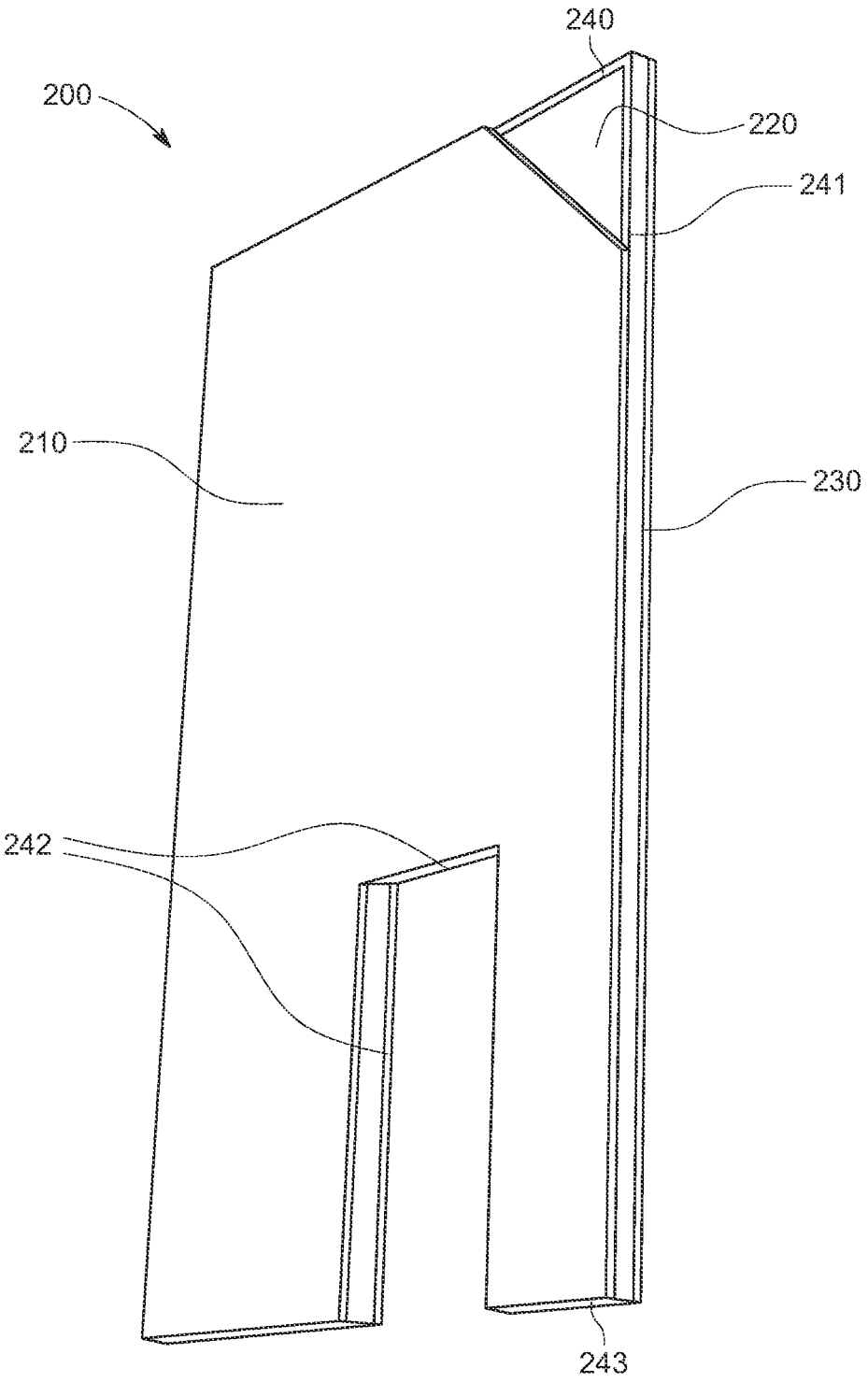
FIG. 2 shows an example of an embodiment of a sandwich wall panel according to the general inventive concepts.

FIG. 2 shows an embodiment of a sandwich wall panel assembly 200 according to the general inventive concepts. The assembly is comprised of a first building panel 210 and a second building panel 230 defining a sandwich cavity therebetween. The first and second building panels 210, 230 each have a first major surface facing an exterior of the assembly 200 and a second major surface facing an interior of the assembly 200. A first insulator 220 in the form of a layer or panel is positioned between the interior facing major surfaces of the first building panel 210 and the second building panel 230. The building wall panels (e.g., concrete panels) are designed to have substantially the same size and will include substantially identical major surface areas. As can be seen from the figure, the shape (i.e., perimeter) of the first insulator 220 is less than that of the first building wall panel 210 and the second building wall panel 230. Positioned around the first insulator on at least one perimeter edge is a second insulator 240 in the form of a ribbon of insulation material. As can be seen, the area of the second insulator is less than that of the first insulator. The Figure shows the second insulator 240 positioned to surround the first insulator 220 on the top edge, lateral edge 241, bottom edge 243, and interior edges 242. Interior edges or openings may be included in the panel assembly to accommodate openings for windows or other access points. In certain exemplary embodiments, the second insulator is positioned around at least one edge of the first insulator, including up to each edge of the first insulator. In certain exemplary embodiments, the second insulator 240 is in the form of individual segments, abutting one another around the perimeter of the first insulator 220. In certain exemplary embodiments, the second insulator is in the form of individual ribbon segments, including segment of 18" to 36" in length. In certain exemplary embodiments, individual segments may be adhered to one another by conventional non-combustible cementitious materials, such as a gypsum cement, to form longer ribbon segments.

The general inventive concepts contemplate a sandwich wall panel assembly comprising a first building panel having a first major surface facing an exterior of the sandwich wall panel and a second major surface facing an interior of the sandwich wall panel; a second building panel having a first major surface facing an exterior of the sandwich wall panel and a second major surface facing an interior of the sandwich wall panel; a first insulator in the form of a panel having a first major surface and a second major surface and a plurality of edges defining a perimeter, the first insulator positioned between the first building panel and the second building panel; and a second insulator in the form of at least one ribbon segment positioned about at least one of the edges of the first insulator.

In certain exemplary embodiments, at least one of the first and second building panels is a concrete panel. In certain exemplary embodiments, both of the first and second building panels are concrete panels.

In certain exemplary embodiments, the first insulator is comprised of a foam selected from extruded polystyrene (XPS), expanded polystyrene (EPS), polyisocyanurate, and phenolic foam insulation. In certain exemplary embodiments, the first insulator is combustible. In certain exemplary embodiments, the first insulator is combustible with ASTM E84 flame and smoke ratings higher than 0 flame & 0 smoke developed. In certain exemplary embodiments, the second insulator is inflammable. In certain exemplary embodiments, the flammability of the second insulator is less than that of the first insulator.

In certain exemplary embodiments, the second insulator is cellular glass. In certain exemplary embodiments, the second insulator comprises a plurality of ribbon segments positioned about the perimeter edges of the first insulator. In certain exemplary embodiments, the area of a surface of the second insulator is 2% to 20% of the area of a major surface of the first building panel. In certain exemplary embodiments, the area of a surface of the second insulator is 5% to 10% of the area of a major surface of the first building panel. In certain exemplary embodiments, the area of a surface of the second insulator is 3% to 7% of the area of a major surface of the first building panel. In certain exemplary embodiments, the second insulator has a width of 2 inch to 12 inch. In certain exemplary embodiments, the second insulator has a width of 2 inch to 6 inch. In certain exemplary embodiments, the second insulator has a width of 3 inch to 4 inch. In certain exemplary embodiments, the second insulator has the same or similar thickness to that of the first insulator. In certain exemplary embodiments, the segments of cellular glass are of unequal width.

Those of ordinary skill in the art will recognize that a variety of sizes of ribbon of second insulator (e.g., cellular glass) might be required depending on the particular needs and specifications of the building to which the wall assembly would be applied. For example, a particular building may require a ribbon of cellular glass that has a larger or smaller width. Likewise, certain assemblies may include segments of cellular glass that have different widths within the same assembly. Each of these falls within the scope of the general inventive concepts.

In certain exemplary embodiments, the general inventive concepts contemplate a method of manufacturing a sandwich wall panel assembly. The method comprises providing a first building wall panel having a first major surface facing an exterior of the concrete sandwich panel assembly and a second major surface facing an interior of the sandwich wall panel assembly; providing a second building wall panel having a first major surface facing an exterior of the sandwich wall panel assembly and a second major surface facing an interior of the sandwich wall panel assembly; positioning a first insulator between the first building wall panel and the second building panel, the first insulator having a first major surface and a second major surface and a plurality of edges defining a perimeter; and positioning a second insulator in the form of a ribbon segment about at least one of the edges.

All references to singular characteristics or limitations of the present disclosure shall include the corresponding plural characteristic or limitation, and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

All ranges and parameters, including but not limited to percentages, parts, and ratios, disclosed herein are understood to encompass any and all sub-ranges assumed and subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more (e.g., 1 to 6.1), and ending with a maximum value of 10 or less (e.g., 2.3 to 9.4, 3 to 8, 4 to 7), and finally to each number 1, 2, 3, 4, 5, 6, 7, 8, 9, and 10 contained within the range.

The sandwich wall panel assemblies of the present disclosure can comprise, consist of, or consist essentially of the essential elements and limitations of the disclosure as described herein, as well as any additional or optional ingredients, components, or limitations described herein or otherwise useful in foam glass composition applications.

The sandwich wall panel assemblies of the present disclosure may also be substantially free of any optional or selected component or feature described herein, provided that the remaining composition still contains all of the required elements or features as described herein. In this context, and unless otherwise specified, the term "substantially free" means that the selected composition contains less than a functional amount of the optional ingredient, typically less than 0.1% by weight, and also including zero percent by weight of such optional or selected essential ingredient.

To the extent that the terms "include," "includes," or "including" are used in the specification or the claims, they are intended to be inclusive in a manner similar to the term "comprising" as that term is interpreted when employed as a transitional word in a claim. Furthermore, to the extent that the term "or" is employed (e.g., A or B), it is intended to mean "A or B or both A and B." When the Applicant intends to indicate "only A or B but not both," then the term "only A or B but not both" will be employed. Thus, use of the term "or" herein is the inclusive, and not the exclusive use. In the present disclosure, the words "a" or "an" are to be taken to include both the singular and the plural. Conversely, any reference to plural items shall, where appropriate, include the singular.

In some embodiments, it may be possible to utilize the various inventive concepts in combination with one another. Additionally, any particular element recited as relating to a particularly disclosed embodiment should be interpreted as available for use with all disclosed embodiments, unless incorporation of the particular element would be contradictory to the express terms of the embodiment. Additional advantages and modifications will be readily apparent to those skilled in the art. Therefore, the disclosure, in its broader aspects, is not limited to the specific details presented therein, the representative apparatus, or the illustrative examples shown and described. Accordingly, departures may be made from such details without departing from the spirit or scope of the general inventive concepts.

While the invention has been illustrated and described in detail in the drawings and foregoing description, the same is to be considered as illustrative and not restrictive in character. It should be understood that only the exemplary embodiments have been shown and described and that all changes and modifications that come within the spirit of the invention are desired to be protected.

The invention claimed is:

1. A sandwich wall panel assembly comprising:

a first building wall panel having a first major surface facing a first exterior of the sandwich wall panel assembly and a second major surface facing a first interior of the sandwich wall panel assembly;

a second building wall panel having a first major surface facing a second exterior of the sandwich wall panel assembly and a second major surface facing a second interior of the sandwich wall panel assembly;

wherein at least one of the first building wall panel and the second building wall panel is a concrete panel;

a first insulating member having a first major surface and a second major surface and a plurality of edges defining a perimeter of the first insulating member, the first insulating member positioned between the first building wall panel and the second building wall panel; and a second insulator in the form of at least one ribbon segment that is separate from the first building wall panel and the second building wall panel, positioned adjoining each of the edges;

wherein the first insulator is combustible and the second insulator is non-combustible.

2. The sandwich wall panel assembly of claim 1, wherein the first insulator is comprised of foam insulation.

3. The sandwich wall panel assembly of claim 1, wherein the first insulator is comprised of XPS, EPS, polyisocyanurate, and/or phenolic foam insulations.

4. The sandwich wall panel assembly of claim 1, wherein the second insulator is cellular glass.

5. The sandwich wall panel assembly of claim 1, wherein the second insulator comprises a plurality of ribbon segments positioned along a plurality of the edges.

6. The sandwich wall panel assembly of claim 1, wherein the segments are of unequal width.

7. The sandwich wall panel assembly of claim 1, wherein an area of the surface of the second insulator is 2% to 25% of the area of the second major surface of the first building wall panel.

8. The sandwich wall panel assembly of claim 1, wherein the second insulator has a width of 2 inch to 12 inch.

9. The sandwich wall panel assembly of claim 1, wherein the second insulator forms a perimeter around the edges of the first insulator.

10. A method of manufacturing a sandwich wall panel assembly, the method comprising:

providing a first building wall panel having a first major surface facing a first exterior of the sandwich wall panel assembly and a second major surface facing a first interior of the sandwich wall panel assembly;

providing a second building wall panel having a first major surface facing a second exterior of the sandwich wall panel assembly and a second major surface facing a second interior of the sandwich wall panel assembly;

wherein at least one of the first building wall panel and the second building wall panel is a concrete panel;

positioning a first insulator between the first building wall panel and the second building wall panel, the first insulator having a first major surface and a second major surface and a plurality of edges defining a perimeter; and positioning a second insulator in the form of at least one ribbon segment, that is separate from the first building wall panel and the second building wall panel, adjoining each of the edges;

wherein the first insulator is combustible and the second insulator is non-combustible.

11. The method of claim 10, wherein the first insulator is comprised of foam insulation.

12. The method of claim 10, wherein the second insulator is cellular glass.

13. The method of claim 10, wherein the second insulator comprises a plurality of segments positioned along a corresponding plurality of edges.

14. The method of claim 10, wherein the area of the surface of the second insulator is 2% to 20% of the area of the second major surface of the first building wall panel.

15. The method of claim 10, wherein the second insulator has a width of 2 inch to 12 inch.

16. The method of claim 15, wherein at least two of the segments differ in width.

17. The method of claim 10, wherein the second insulator is positioned to form a perimeter around the edges of the first insulator.

* * * * *